US007682102B1

(12) United States Patent
Burke et al.

(10) Patent No.: US 7,682,102 B1
(45) Date of Patent: Mar. 23, 2010

(54) ASPHALT TAMPER

(76) Inventors: Gary Burke, 8750 SW. Z Hwy., Trimble, MO (US) 64492; Dale Burke, 8750 SW. Z Hwy., Trimble, MO (US) 64492

( * ) Notice: Subject to any disclaimer, the term of this patent is extended or adjusted under 35 U.S.C. 154(b) by 0 days.

(21) Appl. No.: 12/428,871

(22) Filed: Apr. 23, 2009

(51) Int. Cl.
*E01C 19/35* (2006.01)
*E01C 19/34* (2006.01)

(52) U.S. Cl. ..... 404/133.1; 404/133.05

(58) Field of Classification Search .. 404/133.05–133.2
See application file for complete search history.

(56) References Cited

U.S. PATENT DOCUMENTS

| | | | | |
|---|---|---|---|---|
| 3,865,501 | A * | 2/1975 | Kniep | 404/133.05 |
| 4,015,909 | A * | 4/1977 | Yamamoto | 404/133.1 |
| 4,170,427 | A | 10/1979 | Grane | |
| 4,215,949 | A | 8/1980 | Gabriel, Jr. | |
| D267,800 | S | 2/1983 | Tate | |
| 4,830,533 | A | 5/1989 | Miller | |
| 5,340,233 | A * | 8/1994 | Motl | 404/133.05 |
| 5,372,452 | A * | 12/1994 | Hodgson | 404/112 |
| D393,864 | S | 4/1998 | Waldenberger et al. | |
| 6,374,569 | B1 * | 4/2002 | Suckow | 52/749.13 |
| 6,558,073 | B1 * | 5/2003 | Wrazidlo | 404/133.05 |
| 6,852,155 | B2 * | 2/2005 | Koga et al. | 106/31.58 |
| 7,201,536 | B1 | 4/2007 | Westbrook et al. | |
| 7,316,524 | B1 | 1/2008 | Pikuet | |
| 7,413,028 | B2 * | 8/2008 | Comarmond | 173/132 |
| 2002/0168226 | A1 * | 11/2002 | Feucht et al. | 404/84.1 |
| 2006/0165488 | A1 * | 7/2006 | Morris et al. | 404/133.1 |
| 2007/0065229 | A1 * | 3/2007 | Westbrook et al. | 404/108 |

* cited by examiner

*Primary Examiner*—Raymond W Addie

(57) ABSTRACT

The asphalt tamper includes a tamper plate connected to a reciprocating rod that oscillates inside of a protective sleeve, wherein the reciprocating rod abuts a cam that rotates about the output of a motor. The reciprocating rod has a shoulder that interacts with a spring that applies a biasing force ushering the reciprocating rod back and forth upon interaction with the rotating cam.

4 Claims, 3 Drawing Sheets

ASPHALT TAMPER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of motorized tampers, more specifically, a hand-held tamper that has a variable speed control and is powered by an electric motor.

Manual or motorized tampers have been around for a long time, and provide a valuable service in compacting various types of ground. However, traditional motorized tampers are bulky and do not have variable speed control, or the option to be electrically powered. A variable speed control for a motorized tamper expands the range of different surfaces that require different tamping speeds. The present invention seeks to improve this field of prior art and overcome these limitation by providing a motorized tamper that is lightweight when compared to the prior art, has a variable speed control, and is electrically powered.

B. Discussion of the Prior Art

As a preliminary note, it should be stated that there is an ample amount of prior art that deals with motorized tampers. As will be discussed immediately below, no prior art discloses a lightweight motorized tamper that includes a variable speed control and an electric motor that is powered via a rechargeable battery.

The Grane Patent (U.S. Pat. No. 4,170,427) discloses a vibrating tamper with side-by-side engine section and tamper section connected by a suspension system including leaf springs. However, the vibrating tamper of Grane is big and bulky and not as lightweight as the asphalt tamper claimed below. Additionally, the asphalt tamper of Grane offers only a single tamping speed as opposed to a variable speed control that adjust the tamping speed, and requires the use of springs and an eccentrically-placed engine that is aligned with the tamping force generated.

The Pikuet Patent (U.S. Pat. No. 7,316,524) discloses a tamping device for tamping of asphalt or stone that includes a motor being coupled to a drive shaft that rotates off centered weights as opposed to an oscillating plate that tamps the surface and of which has a variable speed control. Though, the tamping device of Pikuet is not bulky, it relies upon off-centered rotating weights to provide the tamping force as opposed to a reciprocating tamping plate.

The Westbrook et al. Patent (U.S. Pat. No. 7,201,536) discloses an asphalt-patching machine that is mountable to a motor vehicle having a supply of asphalt patch material and tamper thereon. However, the tamper is a part of a patching machine that mounts to a motor vehicle, as opposed to a motorized tamper that is lightweight and can be hand-held.

The Gabriel, Jr. Patent (U.S. Pat. No. 4,215,949) discloses a self-contained asphalt patching apparatus that has a motorized tamper. Again, the motorized tamper is a part of asphalt patching machine and not a hand-held tamper that is lightweight in comparison with variable speed capabilities.

While the above-described devices fulfill their respective and particular objects and requirements, they do not describe a hand-held tamper that a variable speed control and of which is powered by an electrical motor and rechargeable battery. In this regard, the asphalt tamper departs from the conventional concepts and designs of the prior art.

SUMMARY OF THE INVENTION

The asphalt tamper includes a tamper plate connected to a reciprocating rod that oscillates inside of a protective sleeve, wherein the reciprocating rod abuts a cam that rotates about the output of a motor. The reciprocating rod has a shoulder that interacts with a spring that applies a biasing force ushering the reciprocating rod back and forth upon interaction with the rotating cam. The motor is powered by a rechargeable battery, which is located within the housing, and of which the rechargeable battery is recharged upon use of the re-charging cord. The output speed of the motor can be adjusted via a variable speed control.

An object of the invention is to provide a hand-held tamper that is lighter than the traditional motorized tampers that require a heavy internal combustion engine, frame, or that are mounted to a trailer.

A further object of the invention is to provide a tamper that oscillates due to interaction of a cam and a spring-loaded shoulder on the oscillating shaft.

A further object of the invention is to provide a variable speed control that can adjust the speed with which the tamper oscillates.

A further object of the invention is to provide a motor that is powered by a rechargeable battery or that is electrically powered.

These together with additional objects, features and advantages of the asphalt tamper will be readily apparent to those of ordinary skill in the art upon reading the following detailed description of presently preferred, but nonetheless illustrative, embodiments of the asphalt tamper when taken in conjunction with the accompanying drawings.

In this respect, before explaining the current embodiments of the asphalt tamper in detail, it is to be understood that the asphalt tamper is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the asphalt tamper.

It is therefore important that the claims be regarded as including such equivalent construction insofar as they do not depart from the spirit and scope of the asphalt tamper. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated and constitute a part of this specification, illustrate embodiments of the invention and together with the description serve to explain the principles of the invention.

In the drawings.

DETAILED DESCRIPTION OF THE EMBODIMENT

Figure 1:
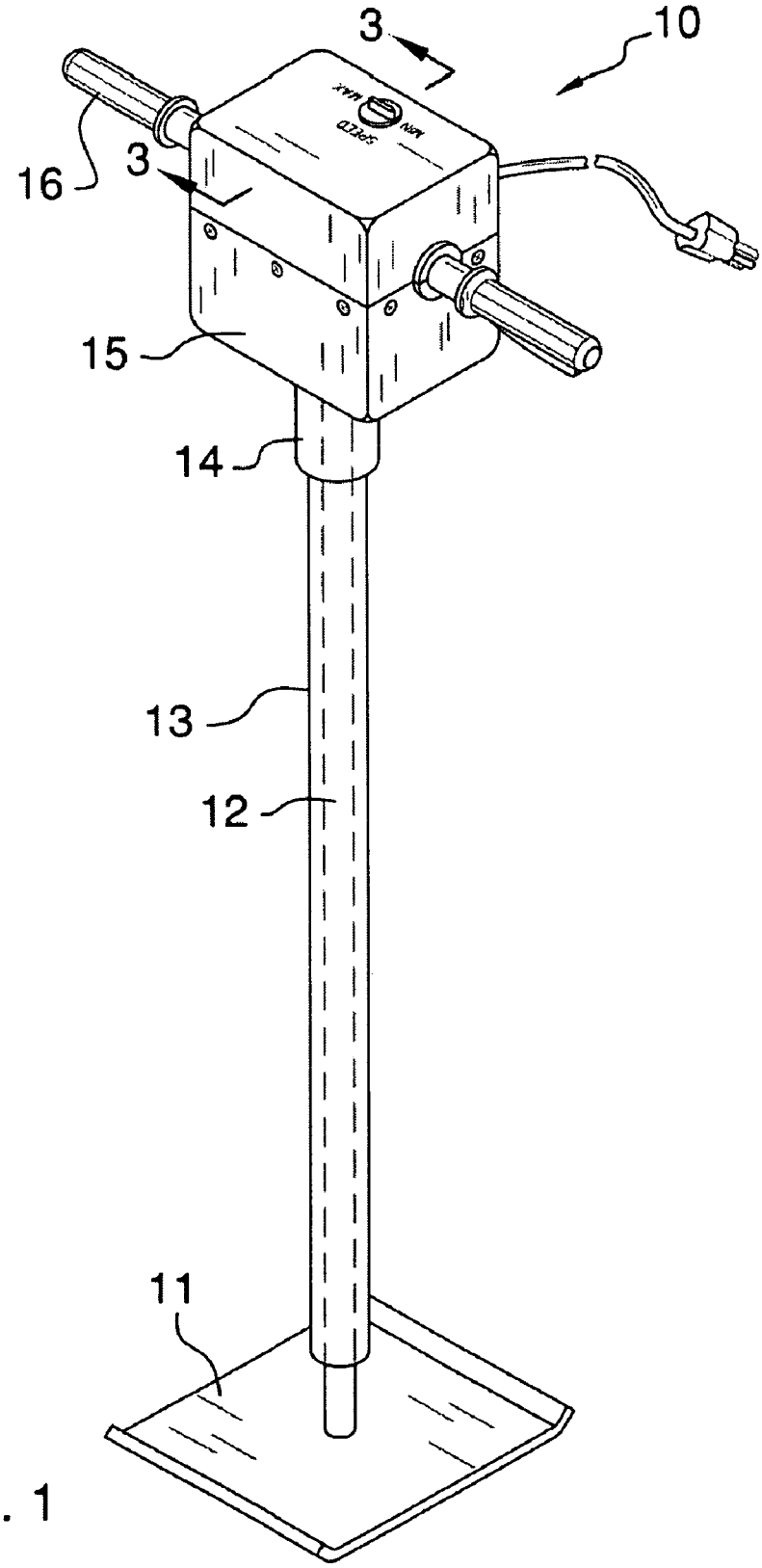
FIG. 1 illustrates an isometric view of the asphalt tamper with hidden lines indicating the reciprocating rod within the protective outer sleeve.
Figure 2:
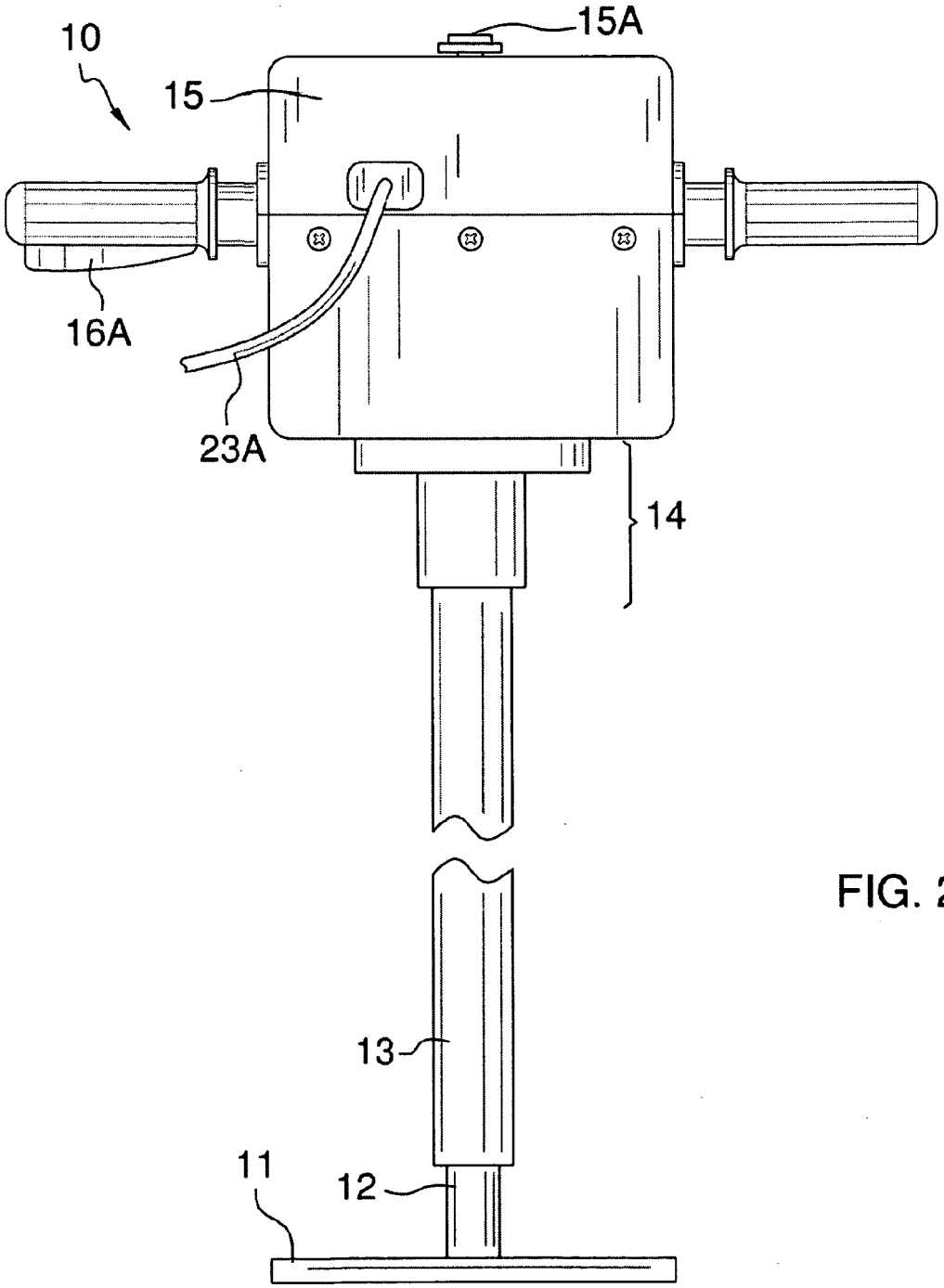
FIG. 2 illustrates a rear view of the asphalt tamper with detail directed to the on/off switch.
Figure 3:
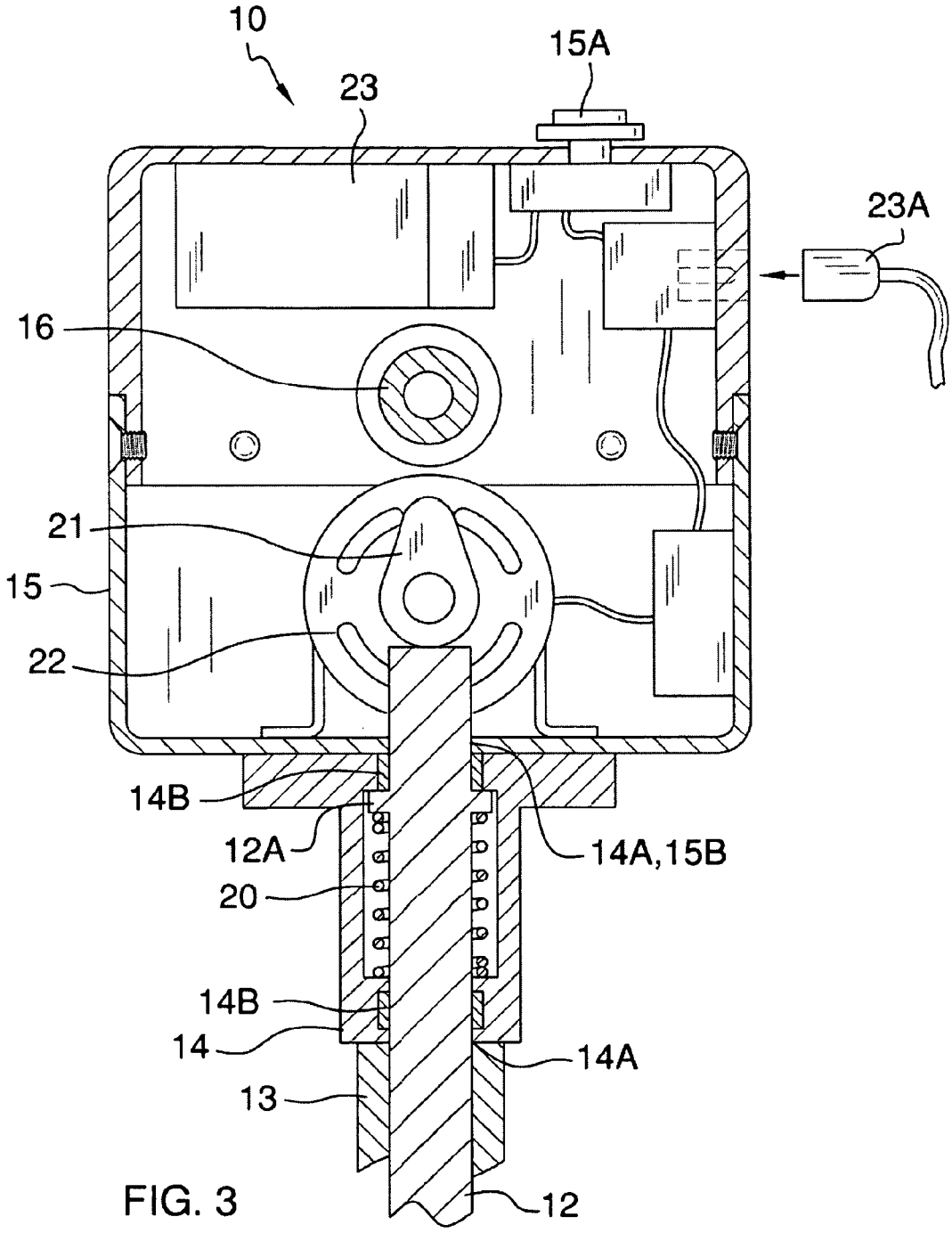
FIG. 3 illustrates a cross-sectional view of the asphalt tamper along line 3-3 in FIG. 1, and detailing the reciprocating rod, shoulder, spring, collar, cam, motor, control module, rechargeable battery, variable speed control, and arrow indicating aligned connection of the removable charging cord.

Detailed reference will now be made to the preferred embodiment of the invention, examples of which are illustrated in FIGS. 1-3. A tamping device 10 (hereinafter invention) comprises a tamping plate 11, reciprocating rod 12, sleeve 13, sub-housing 14, housing 15, and handles 16.

The sleeve 13 runs along the reciprocating rod 12 and protects the reciprocating rod 12. The sleeve 13 is made of a material comprising a metal, rubber, plastic, or carbon fiber composite. The reciprocating plate 12 shall be no less than 3 feet in overall length. The reciprocating rod 12 shall have the ability to move back and forth within both the sub-housing 14 and the housing 15 via openings 14A/15B, respectively. A plurality of bushings 148 are included within the sub-housing 14 to enable a means of sealing off the openings 14A/15B from outside debris while reducing friction between the reciprocating rod and the sub-housing 14.

The reciprocating plate 12 and the tamping plate 11 are made of a metal. The sub-housing 14 and the housing 14 are made of a material comprising a metal, plastic, or a carbon fiber composite.

The tamping plate 11 is connected to a bottom end of the reciprocating rod 12. The reciprocating rod 12 has a shoulder 12A that interacts with a spring 20. The spring 20 also interacts with the sub-housing 14 to provide a biasing upward force upon the reciprocating rod 12, see FIG. 3.

Along a top surface of the reciprocating rod 12 is a can 21 that rotates about a motor 22. The motor 22 is electrically powered via at least one rechargeable battery 23. The rechargeable battery 23 is recharged via a recharging cord 23A.

One of the handles 16 has an on/off switch 16A. A variable speed control 15A is located on the housing 15 and controls the rotational output of the motor 22.

As the motor 22 rotates, the cam 21 in turn rotates, which drives the reciprocating rod 12 up and down in conjunction with the biasing force imposed by the spring 20. The rate at which the reciprocating rod 12 and tamping plate 11 reciprocates is directly related to the input of the variable speed control 15A. The overall weight of the tamping plate 11 and reciprocating rod 12 will directly impact the required power output of the motor 22 as well as to determine the biasing force imposed by the spring 20.

It shall be noted that the re-charging cord 23A, can in addition to re-charging the battery 23, directly power the motor 22 and may replace the battery 23 altogether. The inclusion of the rechargeable battery 23 is to increase the overall mobility of the invention 10 without the requirement of access to a standard wall outlet in relative proximity of the invention 10.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A hand-held tamping device for use in tamping asphalt or stone comprising:

a motor being connected to a rotating cam, said cam rotating in abutment with a reciprocating rod being spring-loaded via a spring acting upon a shoulder located on said reciprocating rod;

wherein a sleeve extends along the reciprocating rod, and is made of a material comprising a metal, rubber, carbon fiber, or plastic;

wherein the reciprocating rod has an overall length no less than 3 feet;

wherein the shoulder of the reciprocating rod and spring are located in a sub-housing extending from below the housing;

output of said motor is adjusted via a variable speed control that regulates the output speed of the motor;

wherein the variable speed control is positioned on an exterior surface of the housing;

said motor being powered by at least one rechargeable battery that is located within a housing, and wherein said rechargeable battery being recharged upon connection with a recharging cord;

wherein handles protrude from the housing and provide a means for handling the tamping device by a single individual;

wherein an on/off switch is positioned upon one of the handles and controls operation of the motor;

wherein a bottom end of said reciprocating rod being connected with a tamper plate that upon reciprocation impacts ground being tamped.

2. The tamping device as described in claim 1 wherein the reciprocating rod and tamper plate are made of a metal.

3. The tamping device as described in claim 1 wherein the sub-housing and the housing are made from materials comprising a plastic, metal, or carbon fiber composite.

4. A hand-held tamping device for use in tamping asphalt or stone comprising:

a motor being connected to a rotating cam, said cam rotating in abutment with a reciprocating rod being spring-loaded via a spring acting upon a shoulder located on said reciprocating rod;

wherein the reciprocating rod has an overall length no less than 3 feet;

the spring and shoulder of the reciprocating rod are housed inside of a sub-housing that extends from below a housing;

output of said motor is adjusted via a variable speed control that regulates the output speed of the motor;

said motor being powered by at least one rechargeable battery that is located within the housing, and wherein said rechargeable battery being recharged upon connection with a recharging cord;

wherein handles protrude from the housing and provide a means for handling the tamping device by a single individual;

an on/off switch is positioned upon one of the handles and controls operation of the motor;

wherein a bottom end of said reciprocating rod being connected with a tamper plate that upon reciprocation impacts ground being tamped;

wherein the reciprocating rod and tamper plate are made of a metal;

a sleeve extends down from the sub-housing along the reciprocating rod.

* * * * *